US005683167A

United States Patent [19]

Tarlow

[11] Patent Number: 5,683,167

[45] Date of Patent: Nov. 4, 1997

[54] AIR SUPPORTED LAMP-SHADE STRUCTURE

[76] Inventor: Kenneth A. Tarlow, 94 Birch Ave., Corte Madera, Calif. 94925

[21] Appl. No.: 512,927

[22] Filed: Aug. 9, 1995

[51] Int. Cl.[6] ..... F21V 33/00

[52] U.S. Cl. ..... 362/96; 362/352; 362/373; 362/450

[58] Field of Search ..... 362/96, 253, 352, 362/373, 437, 438, 439, 450

[56] References Cited

U.S. PATENT DOCUMENTS

| | | | |
|---|---|---|---|
| 1,229,794 | 6/1917 | Salzer | 362/253 |
| 4,542,445 | 9/1985 | Marletta | 362/96 |
| 4,794,498 | 12/1988 | Neumeier | 362/186 |
| 5,295,891 | 3/1994 | Schalk | 362/806 |
| 5,444,607 | 8/1995 | Dreyfuss | 362/96 |

*Primary Examiner*—Alfred Basichas

[57] ABSTRACT

A collapsible lamp-shade structure for a decorative lamp having a light weight flexible material which is supported by a column of forced air emanating from a fan located in the lamp base. The lamp-shade material is held in place by spring clips located on the end of extension arms located at the top of the lamp base. Swivel joints connect the extension arms to the lamp base so that the arms may be folded in creating a pyramid shape in the non use mode or folded out causing the forced air to make the lamp-shade material billow like a parachute. A light bulb located in the lamp base shines up causing the lamp-shade to glow.

6 Claims, 7 Drawing Sheets

AIR SUPPORTED LAMP-SHADE STRUCTURE

FIELD OF INVENTION

This invention pertains to a lamp-shade structure, more particularly to a collapsible lamp-shade structure for a decorative lamp which can be easily assembled and disassembled by the user or customer.

BACKGROUND OF THE INVENTION

Most conventional lamp-shade structures for decorative lamps are so constructed that they can not be disassembled once their components are put together. Such combinations occupy a large space during transportation and transportation costs are thus increased. Although some recent lamp-shade structures can be disassembled as desired, disassembling is not easy and convenient because parts are generally fixed to each other by means of screws which always necessitate the use of hand tools for screwing in and out. One method for overcoming this problem was invented by Kuo-Hsiang Chang as shown in U.S. Pat. No. 4,731,716 dated Mar. 15, 1988. In this invention a series of collapsible wire frame members are hooked together to form a frame ancl decorative material is then laced to the frame to create a lamp-shade. However, even though this design can be set up without the use of hand tools and is somewhat collapsible, it still requires a significant amount of set up time and the collapsed state still occupies a significant amount of space. In another design illustrated in U.S. Pat. No. 4,809,145 by Martin B. Bennett, dated Feb. 28, 1989, a free standing, self-supporting lamp-shade is claimed where the shade is independent of the lamp so as to adjust the light output of the lamp without physically touching the lamp itself. The lamp-shade however is not collapsible and its purpose is to overcome religious prohibitions observed during the Sabbath under Orthodox Jewish law.

Therefore, the main object of this invention is to provide a novel collapsible lamp-shade structure which is free of any framework which is normally needed to give the lamp-shade its shape and is easily assembled and disassembled by the user or customer. Another object of this invention is to provide a lampshade structure which when disassembled takes up a minimum of space for shipping and storage purposes. Another object of this invention is to provide a lamp-shade structure in which the material portion of the shade can be changed easily and quickly.

SUMMARY OF THE INVENTION

In accordance with the present invention there is provided a collapsible lamp-shade structure for a decorative lamp in which a light weight fabric or other light weight material which forms the lamp-shade is supported by a column of forced air emanating from a fan located in the base of the attached lamp. The effect is similar to the way a parachute is maintained in a dome-like inflated condition while falling to the ground. Extendible s hold the light weight material outwards from the base of the lamp so that the light weight material maintains a full look while billowing in its supported state. When the lamp is turned off, the fan located in the base of the lamp is also turned off causing the light weight material to deflate. The extendible arms which hold the fabric can then be swiveled inward so that the tips of the arms touch forming a pyramid shape. In another embodiment each arm is telescoping in nature and can collapse to the point where the shade material is completely contained within the base of the lamp. A recessed grate located near the top of the base of the lamp separates the light bulb from the shade material to prevent burning of the shade material. The shade material can be easily attached or detached by means of spring clips located at the end of the support rods. Lamp-shades of various shapes and sizes can be made. The simplest form is that of a single square sheet of material such as light weight silk which is held at each corner by a retaining clip. Other shapes such as a traditional parachute shape formed of pie shaped sections sewn together will also work. There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and arrangements of the components set forth in the following description illustrated in the drawings. The invention is capable of other embodiments and of being practiced and carded out in various ways. Also, it is to be understood that the phraseology and terminology employed herein are for the purpose of description and should not be regarded as limiting. As such, those skilled in the art will appreciate the conception, upon which this disclosure is based, may be readily utilized as a basis for the designing of other structures, methods and systems for carrying out the several purposes of this invention. It is important, therefore, that the claims be regarded as including such equivalent constructions insofar as they do not depart from the spirit and scope of the present invention. Furthermore, the purpose of the foregoing abstract is to enable the U.S. Patent Office and the public generally, and especially the scientists, engineers and practitioners in art who are not familiar with patent of legal terms all phraseology, to determine quickly from cursory inspection the nature and essence of the technical nature of the application. The abstract is neither intended to define the invention of the application, which is measured by the claims, nor is it intended to be limiting as to the scope of the invention in any way.

DETAILED DESCRIPTION OF THE PREFERRED EMBODIMENTS

Figure 1:
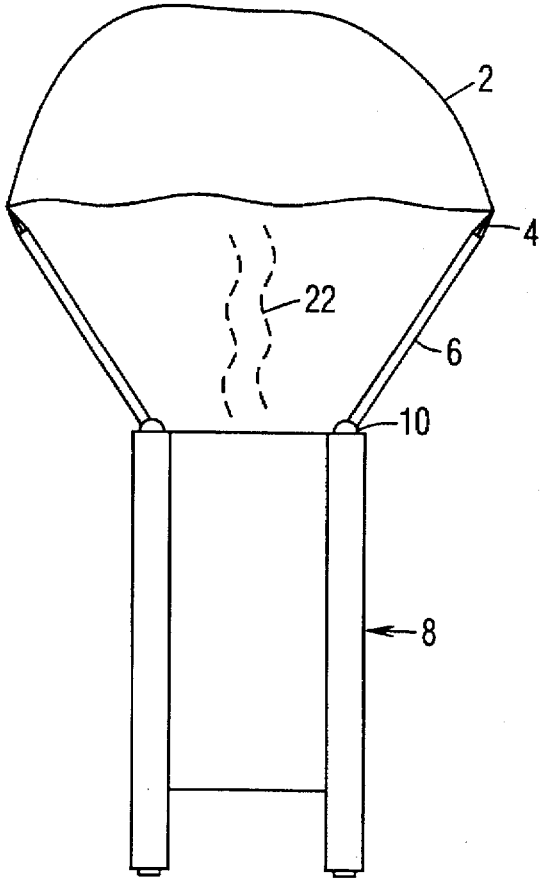
FIG. 1 is a side view of the present invention showing the lamp-shade in billowing open position.
Figure 2:
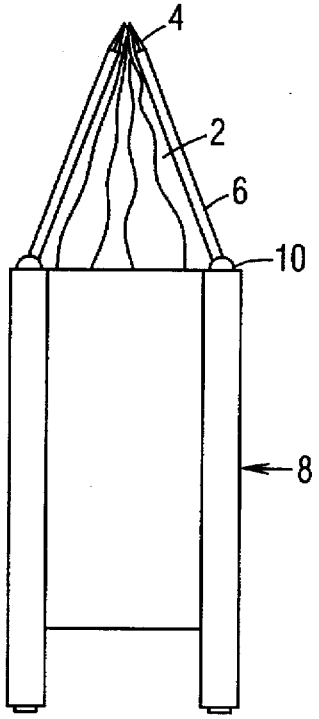
FIG. 2 is a side view of the present invention showing the lamp-shade in its collapsed stored position.
Figure 3:
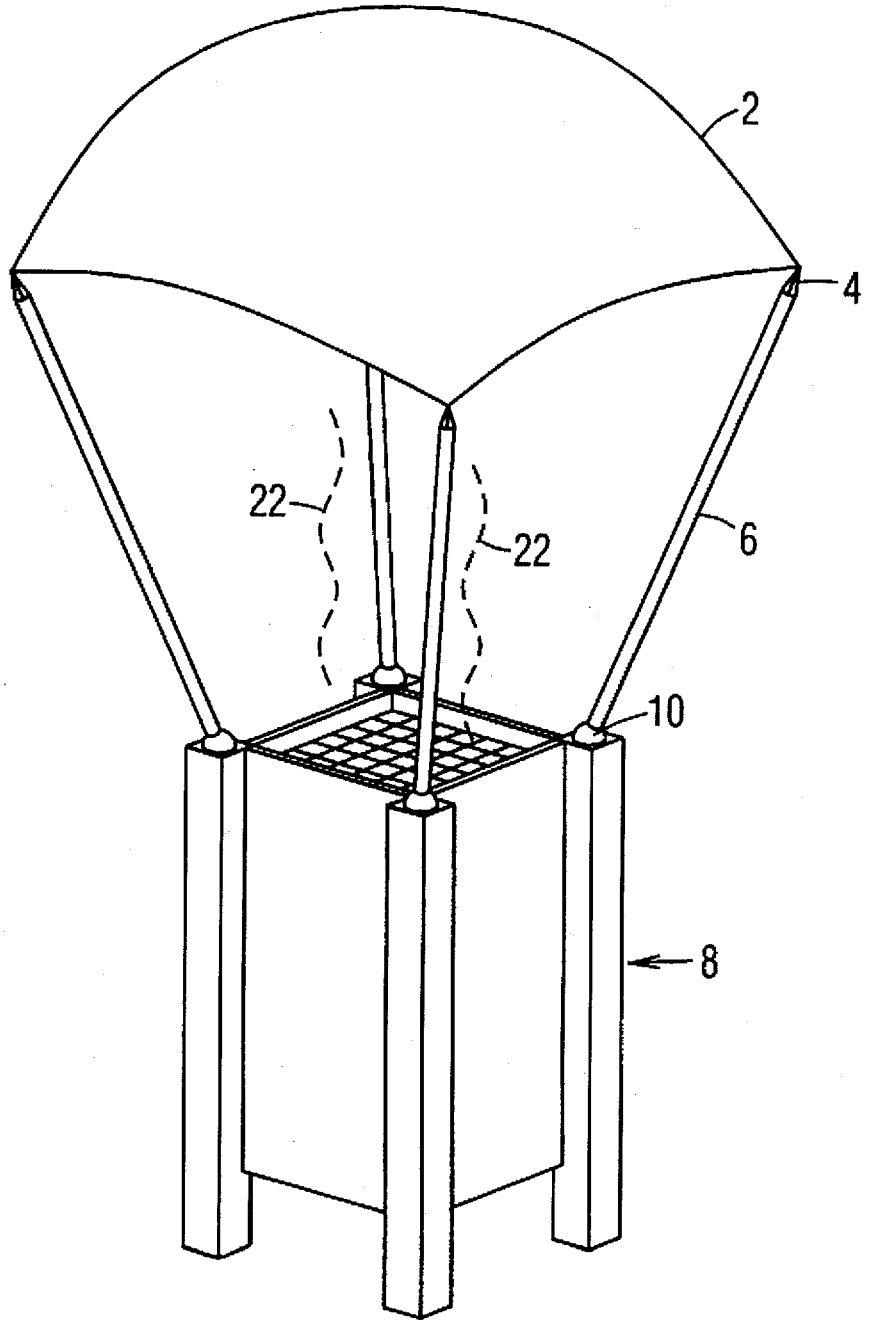
FIG. 3 is a perspective view of the present invention in its open, billowing position.
Figure 4:
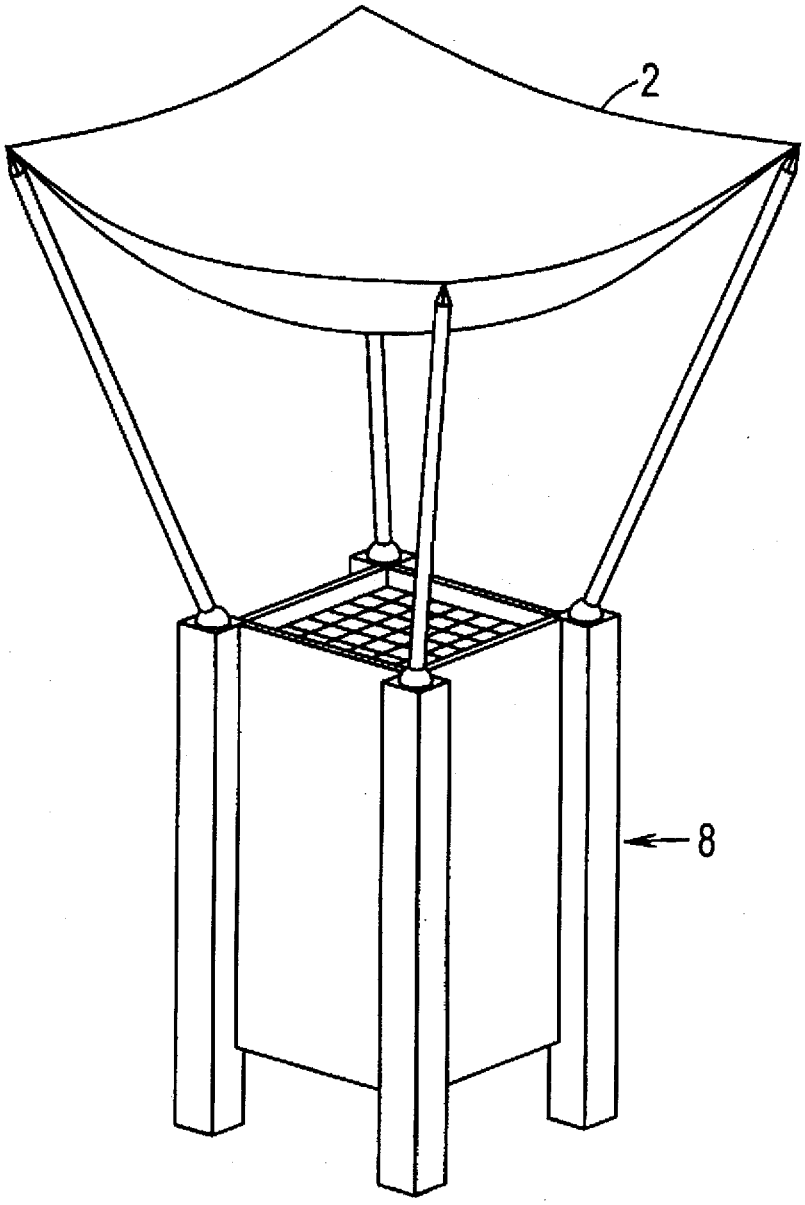
FIG. 4 is a perspective view of the present invention showing the lamp-shade in its deflated position.
Figure 5:
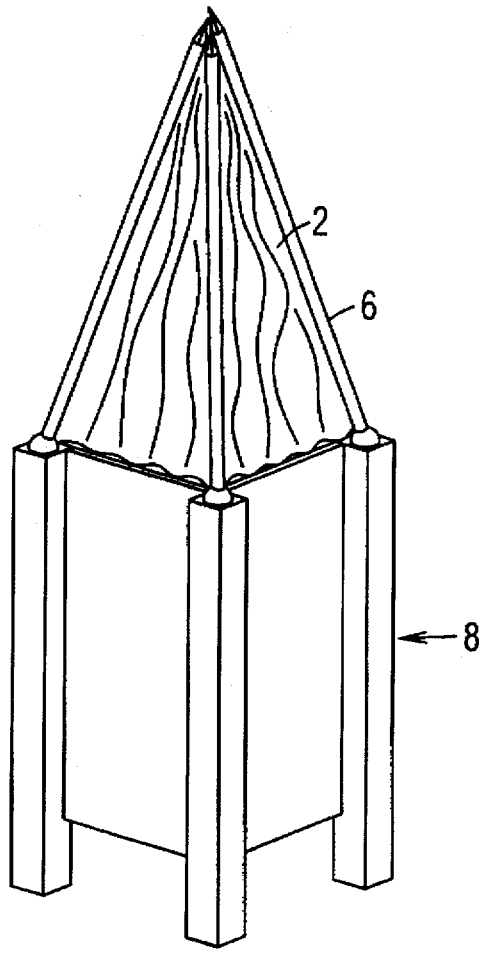
FIG. 5 is a perspective view of the present invention showing the extension arms in the closed, stored position.
Figure 6:
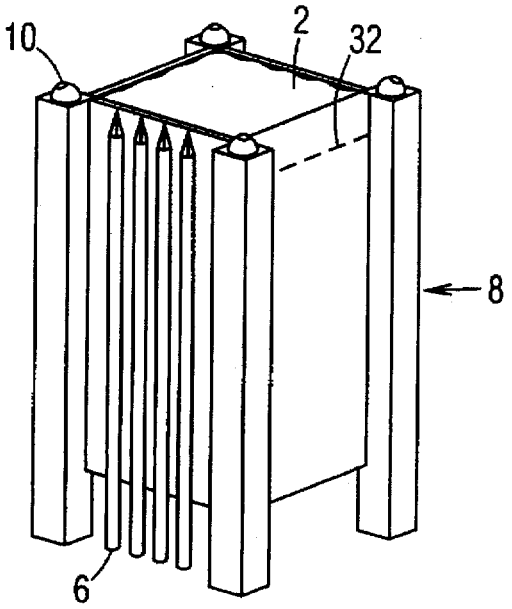
FIG. 6 is a perspective view showing the present invention in its disassembled form, ready to be packed for shipping.
Figure 7:
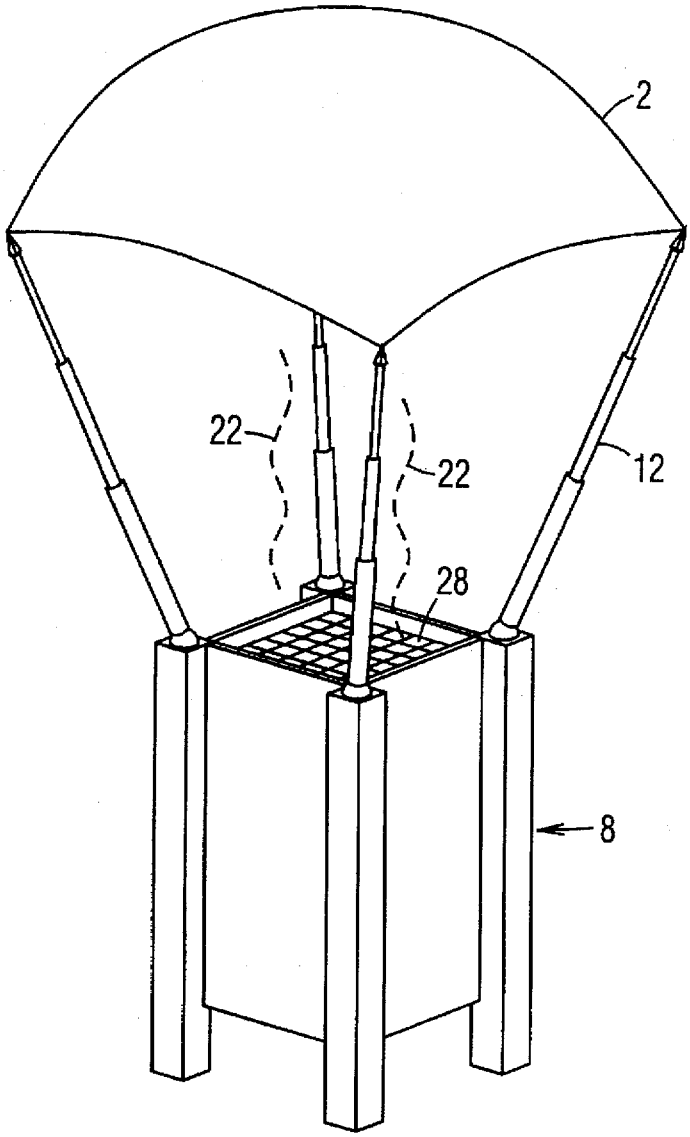
FIG. 7 is a perspective view of the present invention showing an alternate embodiment which uses telescoping extension arms.
Figure 8:
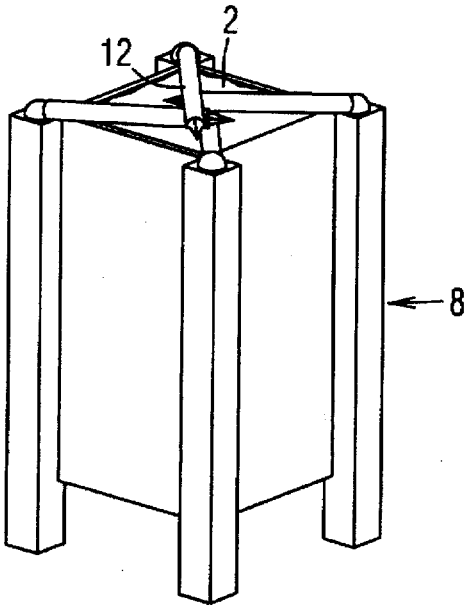
FIG. 8 is a perspective view of the same alternate embodiment showing the telescoping extension arms if the collapsed position.
Figure 9:
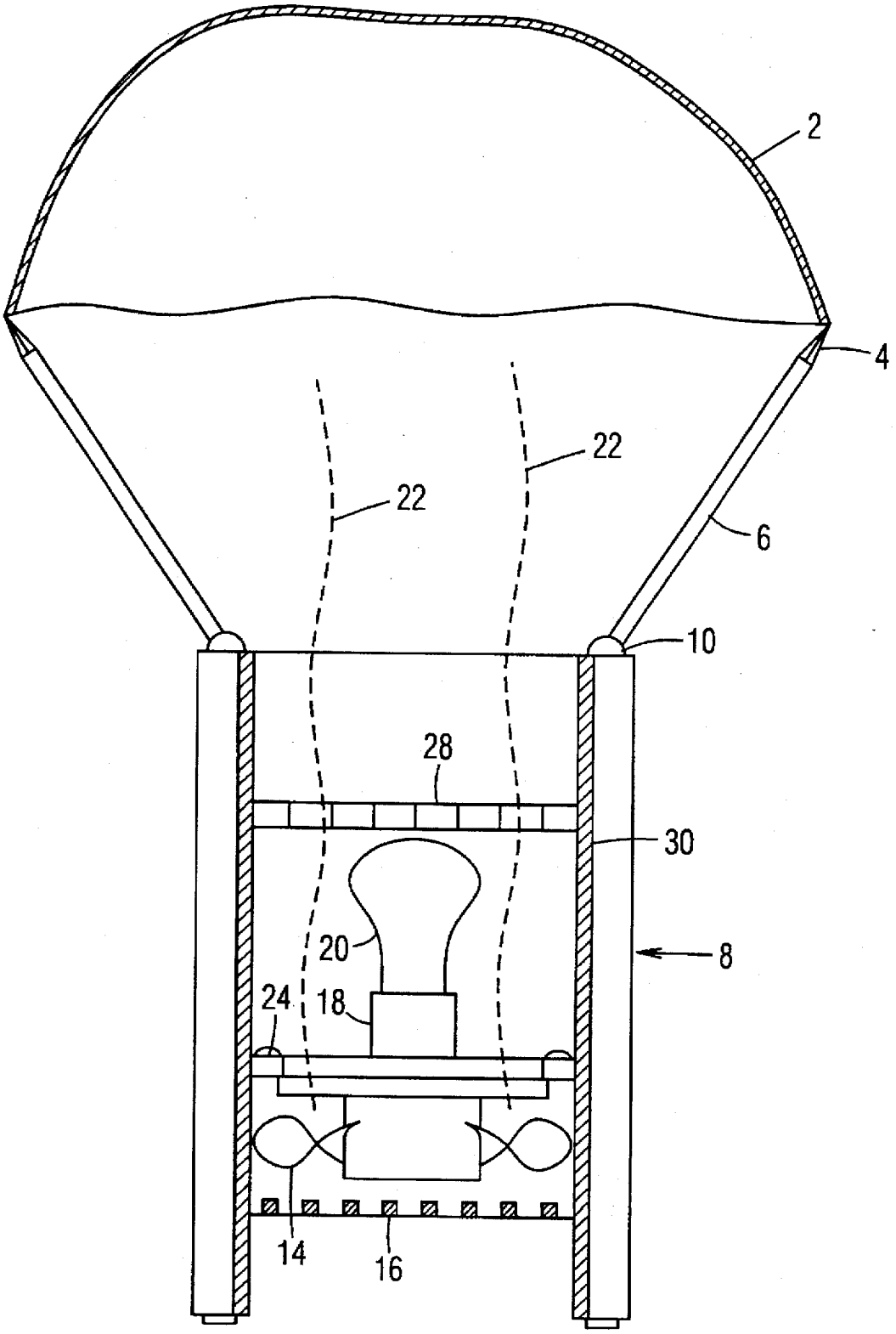
FIG. 9 is a section view of the lamp and shade of the present invention.
Figure 10:
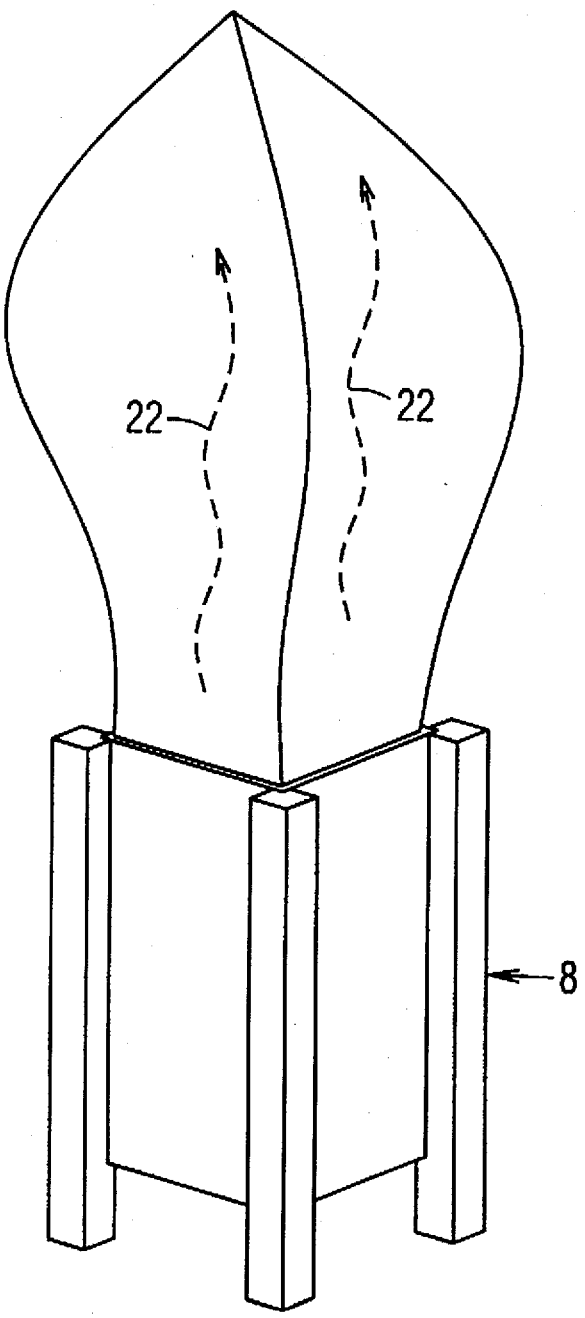
FIG. 10 is a perspective view of an alternate embodiment showing the forced air supported lamp shade continuing all the way down to the top of the lamp base.

FIG. 1 through FIG. 5 show the lamp-shade 2 of the present invention in various states of inflation and deflation. FIG. 1 and FIG. 3 show the lamp-shade of the present invention in the open position where forced air 22 emanating from lamp base 8 is causing the lamp-shade 2 to be supported and to billow like a parachute. FIG. 4 shows the lamp-shade 2 in a relaxed position because no forced air is emanating from lamp body 8. FIG. 9 shows a section view of the present invention while in a use mode. Fan blades 14 spin creating a column of forced air 22 to rise up the hollow body 30 of the lamp base 8. A light socket 18 and bulb 20 are located above the fan 14 in such a way as to not interfere with the rising air 22. Light from light bulb 20 shines on lamp-shade 2 causing it to glow. Cross brace 24 holds light socket 18 and fan 14 in place. Grill 16 protects people from touching rotating fan blades 14. Grill 28 allows air 22 to pass through while creating a visual barrier to the lit bulb 20 below. Grid 28 also provides a barrier between the lamp-shade material 2 and the hot bulb 20 so that the lamp-shade material 2 doesn't burn. A swivel joint 10 is affixed to each corner of the lamp body 30. Extension arms 6 are connected to the swivels 10 so that they can be folded inward as shown in FIGS. 2 and 5 or extended outward in the use mode as shown in FIGS. 1, 3, 4 and 9. Swivel joint 10 has a friction fit so that extension arms 6 remain in the position they are placed by the user. Spring clips 4 hold the lamp-shade 2 in place. Lamp-shade 2 can be easily removed or replaced by squeezing each clip 4. FIGS. 7 and 8 show an alternate embodiment where telescoping extension arms 12 allow the arms 12 to lower and fold in completely with the collapsed lamp-shade 2 nestled between the folded arms 12 and the grill 28 allowing for compact packing and shipping. FIG. 6 shows the primary embodiment ready for packing and shipping where extension arms 6 are removed from swivels 10 and packed along side of lamp body 8. Lamp-shade 2 can be folded and packed in the depressed area 32 located at the top of lamp body 8.

I claim:

1. A collapsible lamp-shade structure, comprising:

a hollow lamp base having an open top;

a fan positioned within said hollow lamp base, said fan directing a column of air upwardly through said open top;

a plurality of extension arms each having an upper end and a lower end, said lower ends being attached around a perimeter of said lamp base at spaced locations; and a lamp shade comprised of a light weight flexible material, said upper ends of said extension arms being attached to said lamp shade around a perimeter thereof at spaced locations, so that said lamp shade is positioned directly above said open top of said lamp base, and said lamp shade is supported and caused to billow by said column of air directed at an underside thereof.

2. The collapsible lamp-shade structure of claim 1, wherein said extension arms are removable from said lamp base for compact packing.

3. The collapsible lamp-shade structure of claim 1, further including a spring clip attached to said upper end of each of said extension arms for removably attaching said lamp shade.

4. The collapsible lamp-shade structure of claim 1, further including a bulb positioned within said lamp base.

5. The collapsible lamp-shade structure of claim 1, further including a swivel joint attaching said lower end of each of said extension arms to said lamp base.

6. The collapsible lamp-shade structure of claim 5, wherein said extension arms can swing inwardly when not in use and outwardly when in use, a friction fit in said swivel joint enabling said extension arms to remain in a selected position.

* * * * *